US005706985A

United States Patent [19]

Feer

[11] Patent Number: 5,706,985

[45] Date of Patent: Jan. 13, 1998

[54] DISPENSING CLOSURE FOR LIQUIDS

[75] Inventor: David L. Feer, Andover, Mass.

[73] Assignee: Holmes Products Corp., Milford, Mass.

[21] Appl. No.: 470,235

[22] Filed: Jun. 6, 1995

[51] Int. Cl.[6] ..... B67D 5/06

[52] U.S. Cl. ..... 222/185.1; 222/469; 222/518

[58] Field of Search ..... 222/185.1, 469, 222/509, 518

[56] References Cited

U.S. PATENT DOCUMENTS

| | | | |
|---|---|---|---|
| 2,685,978 | 8/1954 | Crockett | 222/518 X |
| 3,123,107 | 3/1964 | Kappler | 222/185.1 X |
| 3,201,012 | 8/1965 | Malglaive | 222/518 X |
| 5,131,570 | 7/1992 | Sawyer, III | 222/518 X |
| 5,154,212 | 10/1992 | Weber | 222/518 X |
| 5,222,531 | 6/1993 | Baker et al. | 222/185.1 X |

*Primary Examiner*—Joseph Kaufman
*Attorney, Agent, or Firm*—Hoffman & Baron, LLP

[57] ABSTRACT

A combination cap and handle for use with a detachable humidifier reservoir tank. Extending through the cap is a tubular aperture containing a biased plunger that interacts with a base pin in the water receiving portion of the humidifier. The plunger is attached to a flap such that when the reservoir tank is placed into the body of the humidifier, the plunger and flap are urged into the reservoir tank, allowing the water in the reservoir to fill the humidifier. Extending radially from the plunger aperture on the external surface of the cap are raised handles. These handles allow for a mechanical advantage when the user wishes to remove the cap from the reservoir, or to transport the reservoir more easily both when full and when empty.

14 Claims, 3 Drawing Sheets

DISPENSING CLOSURE FOR LIQUIDS

BACKGROUND OF THE INVENTION

1. Field of the Invention

The present invention relates generally to the dispensing of materials. More specifically, it relates to the dispensing of a liquid from a removable tank. Even more specifically, it relates to a combination container cap and handle wherein the material receiving portion of the apparatus activates a means to create fluid communication between the removable tank and the receiving portion when the tank is placed therein. Yet even more specifically, it relates to a combination cap and handle wherein the means for providing fluid communication includes a biased plunger connected to a flap or valve and where the plunger engages with a protrusion in the material receiving portion of the device. More generally, the present invention could be used in a wide variety of applications wherein a dispensed material is to be freely allowed to flow into a receiving portion, such as a long term animal food dispenser, for instance.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

In a plurality of applications, it is desirable for a tank of material, intended for dispensing into a system, to be occasionally replenished. When this material is a liquid, either a pumping or some other transport mechanism must be used, or else the tank must be detached from the system, moved to a location where it can be refilled, and then moved back to the system or apparatus. One example of such a system or apparatus is a humidifier, such as the type commonly employed in homes. In the vast majority of these devices, the tank is an integral part of the entire apparatus and, thus, has to filled by a pump/transport method. This is achieved in most cases by filling pans or buckets at a faucet, carrying them to the humidifier, and then emptying them thereinto. The time and physical effort involved can serve as an inhibitor to the refilling process. Some people lack the physical strength to carry multiple buckets or pans of water across a room or rooms. Others may begrudge the time it takes. In both scenarios, the upshot is that the humidifying apparatus goes unfilled, thus potentially leading to sinus or respiratory problems, let alone the waste of the apparatus purchase price. The present invention is a cap designed for use with a humidifier system that has a removable tank. The improved combination cap and handle of the present invention has means to interengage with the receiving portion or reservoir of the humidifier such that when the tank is in place, free liquid communication exists between the tank and the reservoir. An activation means in the reservoir engages a biased flap or valve member in the interior of the handle that moves to allow the communication. The cap itself is preferably threaded for attachment to the tank, and includes a raised portion that serves as a handle. A number of U.S. Patents relate to this field and they are discussed hereinafter:

First is U.S. Pat. No. 5,297,703 issued on Mar. 29, 1994 to Chein-Hwa Tsao et al. This discloses a non-spill loading device having a base plate, clamping levers, and a linear valve to open and close a bottle containing a fluid. This is clearly dissimilar from the present invention in that there is no teaching of the biased flap or valve, nor of the outwardly disposed raised handle portion.

In U.S. Pat. No. 5,145,634 issued on Sep. 8, 1992 to Ullrich Hintzen there is disclosed a closing or regulating apparatus for a vessel, specifically, a metallurgical vessel. This device has a movable pipe member that can be set to provide a discharge passage by aligning two discharge openings. Unlike the present invention, there is no showing of a biased flap or valve.

Next is U.S. Pat. No. 5,131,532 issued on Jul. 21, 1992 to Ray C. Ives. This is a contact lens case wherein a perpendicular bar on the interior tray serves both to divide the right and left lens from one another and also to provide a handle for the lifting of the tray from the liquid solution in the case. Unlike the present invention, there is no teaching of any biased flap or valve in the disclosure.

In U.S. Pat. No. 5,287,982 issued on Feb. 22, 1994 to John Tsai, there is disclosed a structure for the external cap of a spout. The apparatus includes a hand grip that can be lifted upwardly from the external surface of the cap body to allow the user to rotate the same. Unlike the present invention, there is no teaching of a biased flap or valve in the cap itself.

U.S. Pat. No. 5,325,981 issued on Jul. 5, 1994 to Jaime L. Klomhaus et al. discloses a plastic reservoir cap. This includes a cap portion with a unitary stem, and where the stem includes fluid measuring indicia. A gasket and locking camming surfaces are also discussed, however this apparatus is clearly dissimilar from the instant invention as there is no teaching of a biased plunger attached to a flap or valve.

In U.S. Pat. No. 4,380,304 issued on Apr. 19, 1983 to George C. Anderson, there is disclosed a container with an integral handle and a closure. This is clearly dissimilar from the present invention in that, as in the patents discussed above, there is no teaching of the biased plunger activating a flap.

Next is U.S. Pat. No. 5,244,113 issued on Sep. 14, 1993 to Charles A. Stymiest. This discloses a container lid assembly wherein a pair of openings each has a hinged closure that incorporates a friction fit and a snap fit seal. This, also, is clearly dissimilar from the present invention in that no biased engaging plunger is taught.

In U.S. Pat. No. 5,267,495 issued on Dec. 7, 1993 to Carmine Magliocchetti et al. there is disclosed an implement for removing a cap from a container. Though this does discuss a biased plunger, the plunger is located in the handle portion of the device and does not control a valve or flap for providing liquid communication between containers or reservoirs.

U.S. Pat. No. 5,294,010 issued on Mar. 15, 1994 to Mark Tschida discloses a pressurizing apparatus and closure. This device has a threaded closure cap, an internal piston mounted therein, and a one way valve to allow ambient air to be pumped into a beverage container as the carbonated contents are consumed. This is unlike the present invention in that no teaching of a raised handle portion is made.

U.S. Pat. No. 5,242,075 issued on Sep. 7, 1993 to Siegfreid Ott et al. discloses a self closing cap for an oil pan filler neck. In this device, a pair of overlying plates, each with an aperture therein, can be moved into alignment to provide fluid communication with the interior of the oil pan. Unlike the present invention, the apparatus does not disclose a biased linear plunger activated by engagement with an outside pin.

The patents hereinafter listed were also uncovered in the search. Though they do describe covers, they are not deemed relevant enough to the instant invention to warrant a detailed discussion.

| Patent No. | Inventor | Date of Issue |
|---|---|---|
| 4,509,654 | Daniel J. Maguire | April 9, 1985 |
| 5,158,194 | Mark A. Sirgo et al. | October 27, 1992 |
| 5,234,122 | Bing J. Cherng | August 10, 1993 |
| 5,280,809 | Bruce E. Tive | January 25, 1994 |

None of the above inventions and patents, taken either singly or in combination, is seen to describe the instant invention as claimed.

SUMMARY OF THE INVENTION

Briefly, the invention comprises a combination cap and handle for use with a detachable humidifier reservoir tank. Extending through the cap is a tubular aperture containing a biased plunger that interacts with a base pin in the water receiving portion of the humidifier. The plunger is attached to a flap such that when the reservoir tank is placed into the body of the humidifier, the plunger and flap are urged into the reservoir tank, allowing the water in the reservoir to fill the humidifier. Extending radially from the plunger aperture on the external surface of the cap are raised handles. These handles allow for a mechanical advantage when the user wishes to remove the cap from the reservoir.

Accordingly, it is a principal object of the invention to provide a new and improved dispensing closure for liquids which overcomes the disadvantages of the prior art in a simple but effective manner.

It is a major object of this invention to provide an improved dispensing closure for liquids wherein the user's placing of the reservoir into position opens fluid communication between it and the humidifier.

It is another object of the invention to provide an improved dispensing closure for liquids wherein a base pin within the humidifier engages a biased plunger within the cap to move a flap or valve, thus opening communication between the reservoir and the humidifier body.

It is another object of the invention to provide an improved dispensing closure for liquids that includes an external handle protruding from its surface to provide a mechanical advantage to the user when the cap needs to be manipulated or removed.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 2:
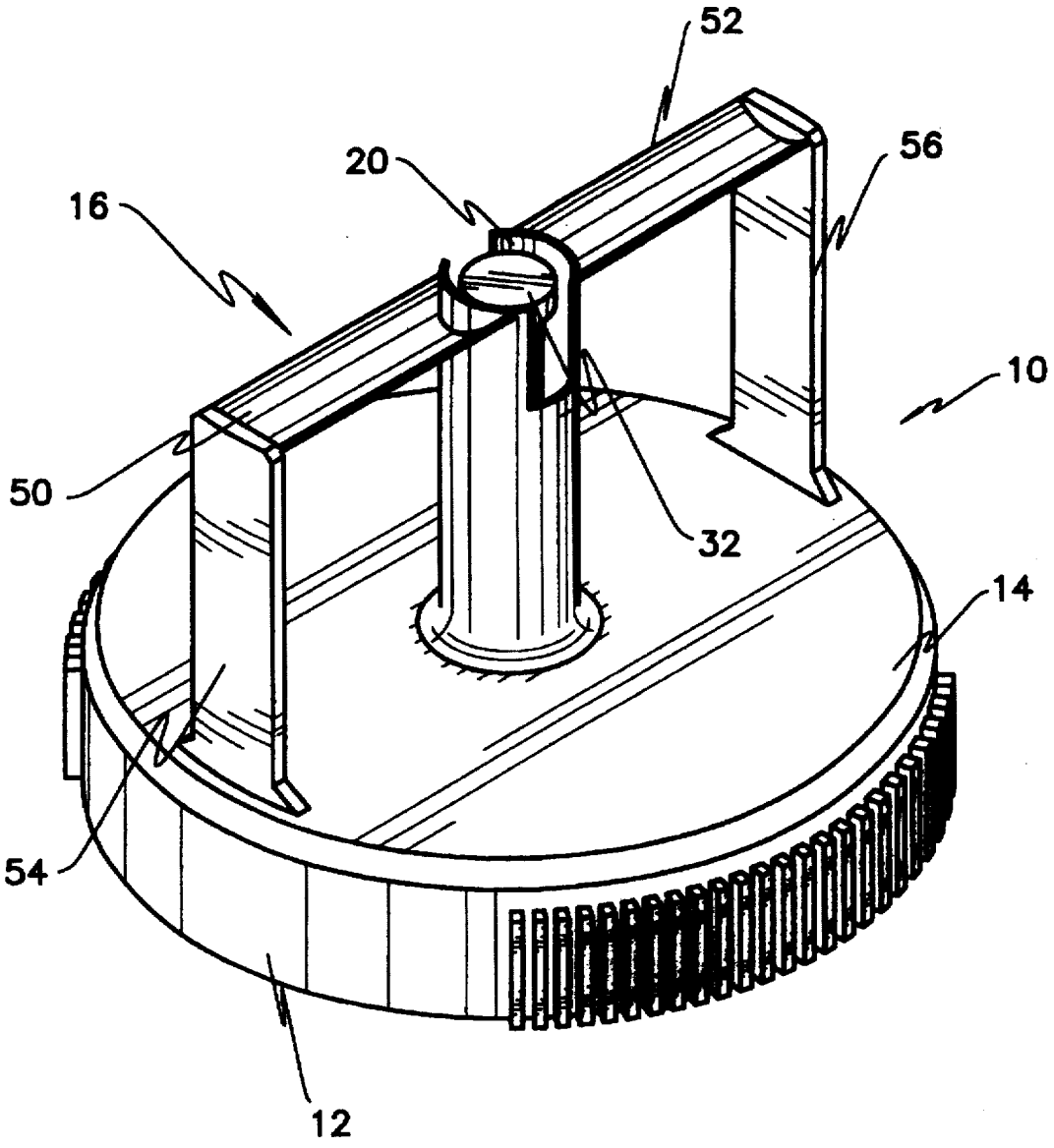
FIG. 2 is perspective view of the cap and handle combination.

The present invention is indicated at 10 in FIG. 2. The cap and handle combination 10 has an outer annular periphery 12 that is textured or pebbled to provide a secure gripping surface. There is a flat external surface or top 14. Protruding from this top 14 is the handle means 16, discussed further below. Proximate the center of the top 14 protrudes a tubular aperture 20, best seen in FIG. 2. The tubular aperture has an interior 22. Contained within the interior 22 of the tubular aperture 20 is the biased plunger 30. At one end of the biased plunger 30 is the base pin engagement end 32, seen in FIGS. 2 and 3.

Figure 1:
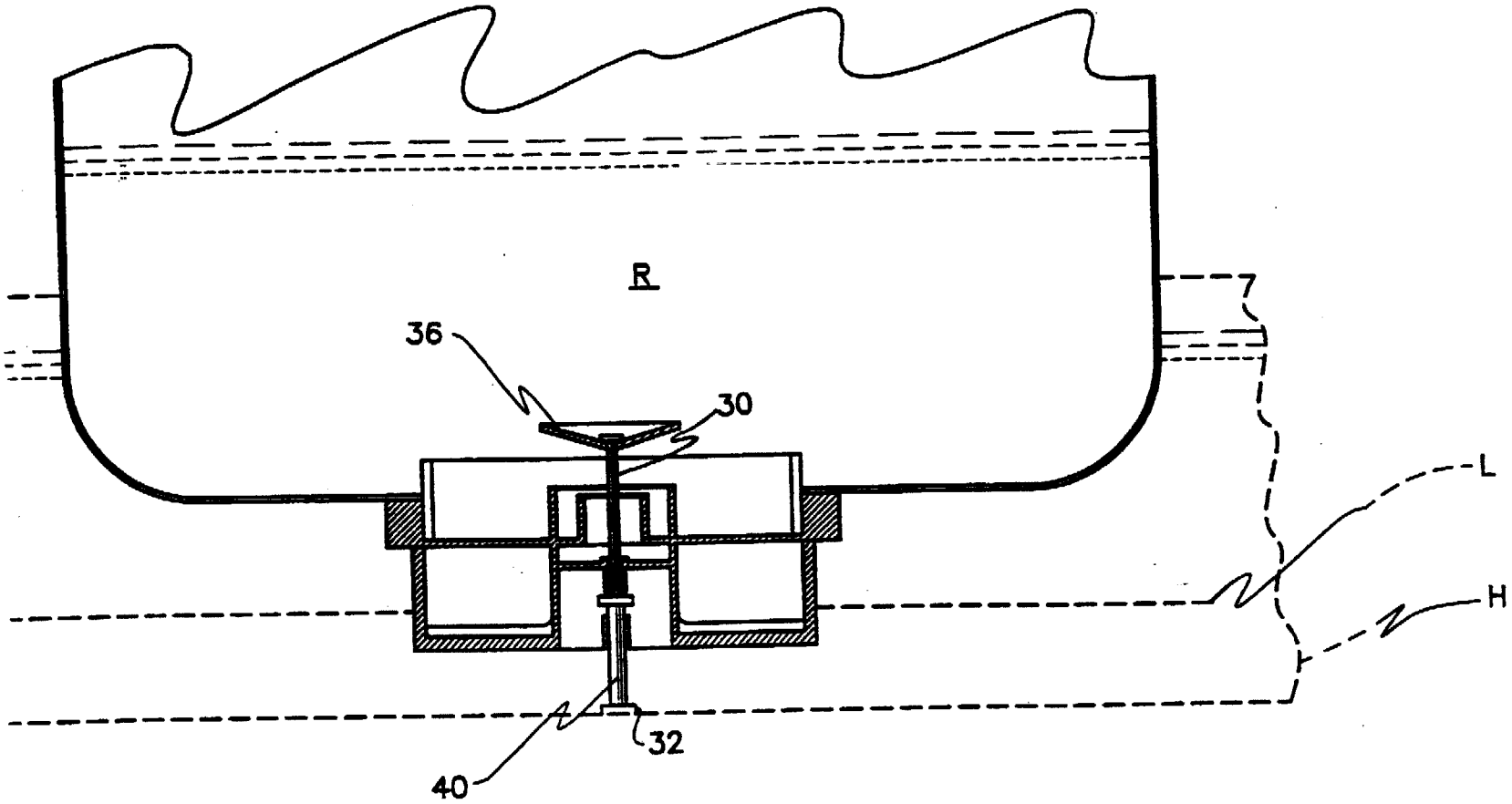
FIG. 1 is a cutaway view of the reservoir in place in the humidifier and showing the fluid communication created through the interaction of the base pin and the cap and handle of the present invention.
Figure 3:
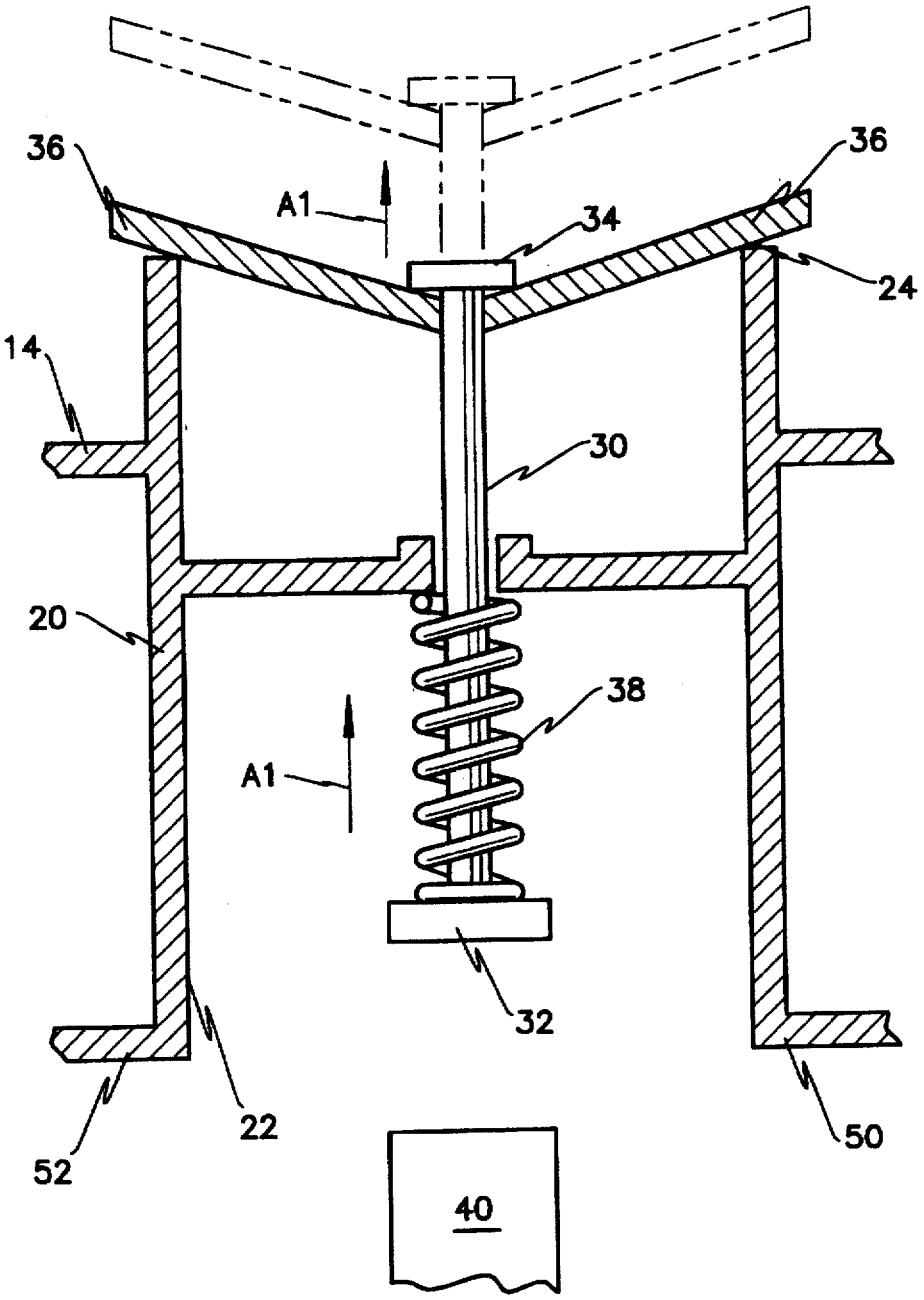
FIG. 3 is a cutaway view of the interior of the cap and handle showing details of the biased plunger and cap.

Referring now to FIG. 1, the discussion will now focus on the way in which the instant invention operates within the contemplated environment. The combination cap and handle 10, as can be seen from the figure, is located on the bottom of the reservoir R. When the reservoir R is placed into the body of the humidifier H (only partially depicted in the figure) the base pin 40 comes into contact with the base pin engagement end 32 of the biased plunger 30. Turning to FIG. 3, it can be seen that as this occurs, the biased plunger 30 is urged in the manner indicated by directional arrows A1. Distal from the base pin engagement end 32 of the biased plunger 30 is the flap engagement end 34. This in turn is connected to a conically shaped elastomeric flap 36. It should be understood that this flap 36 is seen only in cross section in FIGS. 1 and 3. It should also be emphasized that the specific shape of the flap is not limited to that shown here, but could be any workable shape that would dose the reservoir end 24 of the tubular aperture 20. For example, the flap could be generally planar and it could be made of a less flexible material than is described herein. The biased plunger 30, it should be noted, when reservoir R is not in humidifier H, is held by spring 38 in the position shown in unbroken lines in FIG. 3, thus maintaining a seal over the reservoir end 24 of the tubular aperture 20 and preventing any fluid loss therethrough. Thus when the reservoir R is placed in the humidifier H and fluid communication has been established, the water in the reservoir will fill the humidifier H until a sufficient amount has been evacuated to equalize the pressure inside and outside of the reservoir R. When the water reaches a line (indicated at L in FIG. 1) where air can enter the reservoir R, more water will be dispensed. This same property is used in animal watering troughs and is well known.

Turning to FIG. 2, the handle means 16 will now be discussed in detail. Handle means 16, in the preferred embodiment described herein, consists of a pair of oppositely extending members 50, 52. The members 50, 52 extend from, and are integral with, the tubular aperture 20. The members 50, 52 are disposed above the top surface 14 of the cap 10. In the preferred embodiment described herein, the distance above the top surface 14 is approximately 30 mm. The members 50, 52, at their ends distal from the tubular aperture 20, terminate in downwardly depending connecting members 54, 56, that are attached to the top surface 14 of the cap 10 proximate the annular periphery 12. The handle means 16 as thus described allow the user to gain a mechanical advantage when manipulating the cap 10 by allowing the fingers to pass thereunderneath, and by orienting the handle above the vessel's center of gravity when resting on a horizontal surface.

In the actual embodiment illustrated in FIG. 1, line L is located above the level of the bottom of members 50, 52, line L rising to the top of the vertical slots partially defining the boundaries of aperture 20.

The cap 10 is preferably removably attached to the reservoir R by threaded attachment means (not shown), though it should be understood that the cap could be integral to the reservoir R, or attached in other ways familiar to the skilled artisan.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily use the same device to control an animal feeding trough, as mentioned above.

It is to be understood that the present invention is not limited to the sole embodiment described above, but encompasses any and all embodiments within the scope of the following claims:

I claim:

1. An improved cap for use with a humidifier reservoir, said cap including a top, an external face, and an interior face, a humidifier that the reservoir engages including a body having a base pin therein, the cap comprising:

attachment means for attaching said cap to a reservoir fill opening forming a fluid-tight seal therebetween;

a tubular aperture extending between said top, external face and said interior face of said cap;

a biased plunger located within said tubular aperture, said biased plunger having a valve end and a base pin engagement end, said biased plunger including biasing means urging said plunger in the direction of said base pin engagement end thereby closing said valve end; to prevent fluid communication through said tubular aperture; and a handle extending from said top, external face of said cap and terminating at said tubular aperture, said handle providing means for manipulating said cap allowing fingers of a user to pass therethrough for ease of selective attachment to the reservoir, whereby when the reservoir is placed within the humidifier body, said base pin engages said base pin engagement end such that said biased plunger is urged to open said valve end to permit fluid communication through said tubular aperture.

2. The improved dispensing cap as claimed in claim 1, wherein said tubular aperture extends upwardly from said top, external face such that an aperture protruding portion is defined, and said handle comprises a plurality of extending members, said extending members extending radially from said aperture protruding portion to form a pair of substantially U-shaped handle means, said handle extending members being generally parallel to said top, external face of said cap.

3. The improved dispensing cap as claimed in claim 2, wherein said cap includes an annular peripheral outer portion, and wherein said handle extending members are further attached thereto.

4. The improved dispensing cap as claimed in claim 1, wherein said valve end includes a valve being generally conically shaped, and where the apex of said cone is proximate said biased plunger.

5. The improved dispensing cap as claimed in claim 4, wherein said tubular aperture extends upwardly from said top, external face such than an aperture protruding portion is defined, and said handle comprises a plurality of extending members, said extending members extending radially from said aperture protruding portion, said handle extending members being generally parallel to said top, external face of said cap.

6. The improved dispensing cap as claimed in claim 5, wherein said cap includes an annular peripheral outer portion, and wherein said handle extending members are further attached thereto.

7. The improved dispensing cap as claimed in claim 1, wherein the cap is threadably attachable to said humidifier reservoir.

8. In combination a humidifier having a base and a pin extending upwardly from said base;

a reservoir tank removably positionable on said base, the reservoir tank having an opening for filling the tank; and a cap selectively attachable to the reservoir tank for closing the tank opening, the cap including a biased valve means for selectively providing fluid communication from an external surface to an interior space of the cap, such that the valve means is biased to be closed, the valve means being opened when said valve means engages said pin of the humidifier base, the cap further including a handle, the handle having a first extent extending upwardly from the external surface of the cap and a second handle extent extending from said first handle extent substantially parallel to said external surface, the handle providing means for manipulating said cap to be selectively attachable to the reservoir tank fill opening.

9. The combination of claim 8, wherein the valve means comprises a tubular aperture having a valve positioned therein, the valve including a valve end and a plunger end, the valve end being responsive to movement of the plunger end.

10. The combination of claim 8, wherein the valve means comprises a tubular extension having a plunger end extending above said external surface of said cap and a valve end in the interior space of said cap, the handle including at least two handle members extending radially from the plunger end of the tubular extension and terminating at a periphery of said cap.

11. The combination of claim 8, wherein the cap is threadably attachable to said reservoir tank.

12. An improved cap for sealing a refill opening of a humidifier tank, the cap comprising:

a substantially circular top surface and a downwardly depending skirt portion;

a tubular aperture extending through said top surface of the cap, the tubular aperture having a first end extending upwardly from the top surface of the cap;

a valve positioned within the tubular aperture for selectively providing fluid communication from an external surface of the cap to an interior space of said cap; and a handle having at least one handle member extending radially from the first end of the tubular aperture to periphery of said cap, the handle providing means for manipulating said cap to be selectively attachable to a humidifier tank refill opening.

13. An improved cap as claimed in claim 12, wherein the handle comprises two handle members extending radially in opposite directions from the first end of the tubular aperture to a periphery of said cap thereby forming two substantially open handle portions allowing a user's fingers to pass therethrough.

14. The improved cap as claimed in claim 12, wherein the cap is threadably attachable to a humidifier tank refill opening.

* * * * *